US005097764A

United States Patent [19]

Waizmann

[11] Patent Number: 5,097,764

[45] Date of Patent: Mar. 24, 1992

[54] PROCESS AND APPARATUS FOR CLEANING THE BLANKET CYLINDERS OF A ROTARY OFFSET PRINTING PRESS

[75] Inventor: Franz Waizmann, Gessertshausen, Fed. Rep. of Germany

[73] Assignee: Baldwin-Gegenheimer GmbH, Augsburg, Fed. Rep. of Germany

[21] Appl. No.: 605,143

[22] Filed: Oct. 29, 1990

Related U.S. Application Data

[63] Continuation of Ser. No. 532,250, Jun. 1, 1990, abandoned, which is a continuation of Ser. No. 219,291, Jul. 14, 1988, abandoned.

[30] Foreign Application Priority Data

Jul. 15, 1987 [DE] Fed. Rep. of Germany ..... 3723400

[51] Int. Cl.[5] ..... B41L 41/00

[52] U.S. Cl. ..... 101/425; 101/488

[58] Field of Search ..... 101/424.1, 424.2, 416.1, 101/487, 488, 423, 425

[56] References Cited

U.S. PATENT DOCUMENTS

| | | | |
|---|---|---|---|
| 2,157,387 | 5/1939 | MacArthur | 101/416.1 |
| 2,275,521 | 3/1942 | Gessler | 101/416.1 |
| 2,464,119 | 3/1949 | Dawson | 101/424.1 |
| 2,974,058 | 3/1961 | Pihl | 101/416.1 |
| 3,095,810 | 7/1963 | Harris | 101/416.1 |
| 3,506,467 | 4/1970 | Ulrich | 101/416.1 |
| 3,508,711 | 4/1970 | Switall | 239/562 |
| 3,694,238 | 9/1972 | Tinghitella et al. | 101/424.2 |
| 4,150,495 | 4/1979 | Stern | 101/424.1 |
| 4,344,361 | 8/1982 | MacPhee et al. | 101/425 |
| 4,667,597 | 5/1987 | Wright et al. | 101/425 |
| 4,686,902 | 8/1987 | Allan et al. | 101/425 |
| 4,781,115 | 11/1988 | Ueda et al. | 101/425 |
| 4,852,492 | 8/1989 | Pfizenmaier | 101/424.1 |

FOREIGN PATENT DOCUMENTS

| | | | |
|---|---|---|---|
| 2538067 | 1/1976 | Fed. Rep. of Germany | 101/425 |
| 1587497 | 4/1981 | United Kingdom . | |

*Primary Examiner*—Edgar S. Burr
*Assistant Examiner*—Ren Yan
*Attorney, Agent, or Firm*—Morgan & Finnegan

[57] ABSTRACT

This invention relates to a process and apparatus for cleaning the rubber blankets of a rotary offset printing press while the web is running. The cleaning agent used to remove ink and paper residue from the rubber blanket is partially transferred to the web and passed to the dryer. At an advanced stage of the printing run, where we can observe a rise and subsequent drop in the ink residue curve paralleled by a corresponding curve for the cleaning solution load, undesirably high fume release levels may occur. These fume levels may, on one hand, be controlled via the cleaning program. On the other hand, it is possible to adjust these fume levels by influencing the fume release through the application of a suitable agent to the web surface. The application of this material will inhibit the fume release and alter the component moieties in the fumes while additionally permitting the released components to be sealed off. The material utilized is predominantly water. The dryer inlet section is equipped with a spraying system which is fed the correct dose (in terms of quantity and time) of said medium to ensure the lowest possible concentration of explosive or noxious fumes.

11 Claims, 2 Drawing Sheets

PROCESS AND APPARATUS FOR CLEANING THE BLANKET CYLINDERS OF A ROTARY OFFSET PRINTING PRESS

This is a continuation of co-pending application Ser. No. 07/532,250, filed on June 1, 1990 which in turn is a continuation of application Ser. No. 07/219,291 filed July 14, 1988, which are both abandoned.

This invention relates to a process and apparatus for cleaning of a rubber blanket mounted on the blanket cylinder of a rotary offset printing press.

One design of the generic type is disclosed in DE 30 05 469 A1. It relates, in a general way, to the cleaning of rubber blankets as found in rotary printing presses. The design can be applied to the blanket cylinders of both sheet-fed and web-fed printing machines.

The rubber blankets are subject to contamination in the course of the printing process, mainly as a result of the build-up of sticky ink residue and deposited paper dust. This will deteriorate the dot definition so essential in autotypical halftone printing applications, leading to poor printing quality in the areas concerned.

In order to remedy these faults due to blanket contamination, it is standard practice to interrupt the printing process and clean the rubber blankets manually or through the agency of a suitable apparatus. DE 30 05 469 A1 presents a design wherein the blanket is cleaned with the aid of an apparatus consisting of a cleaning beam mounted axially parallel to, and across from, the blanket cylinder of the printing unit, said cleaning beam being equipped with a pressure element which can be brought into and out of contact with the rubber blanket moving past it. The cleaning action is due to friction and the solution of foreign particles on the blanket, the foreign particles being subsequently taken up by a cleaning blanket utilized in the blanket cleaning cycle.

The washing beam of a blanket cleaning system is usually located ahead of the nip through which the web is passed, i.e., before the inking unit. This location ensures that the ink and fountain solution are supplied from the plate cylinder to the web via the shortest route, and with minimum retention time. Any cleaning solution spilled to the blanket cylinder will travel to the web by the same route as the ink. A portion of this cleaning solution is transferred to the web, while the other portion remains in place and is conveyed back to the cleaning point.

On the other hand, space and design requirements may also dictate that the washing beam be mounted in the return area between the nip and the plate cylinder. At this position the blanket has just transferred ink and fountain solution to the web and, while being in contact with the latter, picked up the latest paper particles before it is again passed over the printing plate carrying the fountain solution and ink.

For the duration of the cleaning process the inking and damping units are usually out of operation, i.e. in a raised position, in order to prevent dirt particles and cleaning solution from being retransferred to the inking and damping rollers, from where they might pass to the ink and damping water fountains.

Such shutoff of the inking and damping units during the cleaning process is, however, not a necessary condition. The procedure to be selected will depend on the type of printing machine, with previously gathered experience playing an important role. Thus the risk of a web rupture, for instance, is greater when the dampening unit is switched off during cleaning, because the subsequent reactivation of the dampening system will produce an initial burst of fountain solution. In view of this fact, it may be necessary to keep the dampening unit in operation.

The adequate ON/OFF setting of the inking and dampening units will thus have to be determined on the basis of specific machine and production characteristics. Major non-printing areas resulting in larger damping fluid transfer surfaces, or, inversely, a high image density, may call for individually adapted operating modes, as may coated or uncoated, or light or heavy paper.

During the actual cleaning process, the cylinders of the printing unit are kept in the 'impression on' position, rotating against one another under a certain surface pressure, with the nip through which the web is passed in its closed position. Cleaning can also be performed under 'impression on' conditions, i.e., with an open nip. The cylinder control positions depend on the individual course of the web, which, in the case of typical four-cylinder systems with their offset levels formed by the axes of the plate and blanket cylinders, takes the shape of the letter 'S', thereby ensuring that the web is in contact with the rubber blanket in both positions. This contact between the web and the rubber blanket permits a transfer of impurities and cleaning solution with the web.

In satellite systems the selection of the cylinder setting will depend on the printing couple configuration.

Cleaning is achieved by moving the pressing element from its position of rest to its working position, i.e., into frictional contact with the rubber blanket. The pressing element establishes a line (or area) of contact between the cleaning blanket and the rubber blanket, thereby again permitting impurities and/or cleaning solution to be transferred to the other side. A typical pressing element consists of a controllable diaphragm, but may also take the form of a rotating or fixed brush.

The cleaning solution consists of a hydrous phase component, which is mainly directed at the paper dust, and organic solvent ingredients intended to soften and/or dissolve ink residue. Mixtures may also be utilized. Another standard procedure is to add certain ingredients separately in a given sequence.

The efficiency of the cleaning cycle is largely a function of the individual washing program controlling the times and quantities in which the cleaning ingredients are applied. Another important factor in the process is the advance rate of the cleaning cloth in terms of the ratio between contaminated, soaked portions and clean surface area.

At the state of the art reflected in DE 30 05 469 A1, the liquid cleaning components are applied in relation to the advance rate of the cleaning cloth, using time-controlled valves inserted in the supply lines and servo drives controlled in conjunction with the former. The commands are given from a common control unit.

Cleaning is necessary whenever the printing quality has deteriorated as a result of contamination symptoms. Although modern alcohol-film damping units allow the user to influence a plurality of parameters (areas on which the fountain solution is applied, ductor speed, alcohol concentration, etc.) to control the contamination of the blanket, cleaning of the blanket will eventually become inevitable as printing proceeds to ensure an adequate service life of the plates and blankets.

The cleaning cycle is initiated directly during production printing, with the machine in continuous operation. The waste rate is minimized according to the cleaning program, which can be adapted to match the individual machine and order specifications. Cleaning can also be coordinated with general maintenance-related events, i.e., to coincide with a machine shutdown for a change of plates, an intervention on the folder, etc. The reduction in machine speed from continuous operation to a shutdown, and its subsequent acceleration from rest to continuous production conditions, will thus become unrelated, as it were, to the need for a blanket cleaning cycle.

The impurities to be removed, including the cleaning agent, are transferred partly to the cleaning blanket and partly to the web, which, having passed the printing unit, moves on to the drying and folding units. This will necessarily produce a situation where the dryer, which in rotary offset printing is intended to transform the heat-setting ink into a pasty state by evaporating its liquid contents, has to cope with an additional cleaning agent load. As regards the drying process in rotary offset printing, we refer to the data in "Druckwelt" (Printing World) 13/1971, pp. 590 to 592, and "Papier und Druck" (Paper and Printing), 24, 1985, p. 74 et seq.

As a consequence, the concentrations in the gas phase of the drying oven (which operates with a slight underpressure) will change for the duration of the cleaning cycle. This variation in concentrations observed between steady production conditions and conditions during the cleaning cycle must be counteracted in order to minimize the risk of malfunctions in both the drying and the post-drying sections, e.g., the after-burners. The prime goal in this context is to prevent impermissible concentrations which might lead to an explosion, or a rise of noxious gas outputs beyond legal thresholds.

The brochure on "Safety Rules for Anti-Explosion Protection on Continuous Dryers", published by Carl Heymanns Vergla AG, Koln, 1984, contains data on dryer monitoring systems. According to these specifications, such monitoring equipment must include a temperature display with a temperature control device set to prevent the unit from exceeding a temperature limit of 80% of the ignition temperature. The regulations call for a gas detection system taking 5 measurements per minute at each measuring point. This state of the art regarding the equipment of the drying unit is not reflected by actual practice, where detector systems are rarely used and dryers are operated on a rule-of-thumb basis with no specific consideration being given to the cleaning cycle.

Given the problems of an increased vapor release during cleaning, a number of dryer manufacturers recommend fully open dryer exhaust flaps to improve the gas extraction, with the dryer burners and rotary blower operating at undiminished speed.

Operating instructions defined for the cleaning cycle are rigid and purely preventive in character, containing no adjustments for actually encountered operating conditions and the gas concentrations observed in the field.

For the after-burner system, however, it is known that the increased portion of combustible exhaust gases produced by the cleaning process, in conjunction with the elevated calorific value of these exhaust gases, may produce overtemperatures in the combustion chamber.

A process control system designed to reduce or eliminate malfunctions would necessarily have to take into account the various parameters of the actual printing process, the drying cycle, and the materials and additives involved. The vapor quantities released in the dryer can be influenced, to the extent to which they are due to cleaning compounds, via the choice of liquid ingredients determining the composition of the cleaning solution. Another factor in this context is the printing image with its proportion of printed surface areas, for in the maximum case of 400% image superimposition (over-printing of all chromatic colours plus black), the ink vapor concentration will, accordingly, be very high. The obvious approach, therefore, would be to consider the proportion of the image areas as in input parameter. If the percentage of blank, i.e., paper-white surface area is high, the ink fume percentage will in turn be low while the damping solution will be present in elevated concentrations.

The process is also influenced by portions of the fountain solution which are propelled into the web during printing; moreover, the absorption of the cleaning solution by the web will differ for natural and coated paper, etc.

The object of the present invention, therefore, is to provide a simple means to influence the vapor concentration curve in the dryer.

The solution is essentially directed at a reduction in those process components which are additionally evaporated during the cleaning cycle, and it is achieved by means of a material measure. It consists of the features listed in the characterizing clause of claim 1.

In contrast with this invention, CH 287 535 discloses a process wherein steam is blown on to the top surface of the web. This superheated steam, which can be made to carry still further heat, is intended to evaporate moisture from the web. From DE 27 59 666 B2 we know a process using hot steam as a web conditioning medium, the said steam being blown on to the web from a conditioning tunnel mounted in the dryer inlet section.

Although such steam would also modify printing conditions in the dryer oven, it merely conditions the web by preventing it from overdrying.

In the solution according to the invention, however, the material applied to the web before the drying stage, that is, an auxiliary agent or compound will enter into a physical or chemical reaction with the web surface. Physically speaking, its wetting properties will prevent the evaporation of gaseous products produced by the effect of heat from the ink and/or from the cleaning solution. By absorbing heat, the medium itself will produce a change in the heat transfer process. The actual cleaning solution will thus heat up at a later point and by a different amount.

From a chemical point of view it is possible to apply a rapidly polymerizing material which will form a coating, as it were. In the case of inorganic agents, such a coating can be obtained by sedimentation from an originally aqueous solution.

The coating will thus seal off the web against an evaporation of components.

Water as a process material is easy to handle and provides a number of advantages with respect to availability, lack of agressivity, and manageability in combination with hazardous matter. Moreover, the moistened web will be easier to fold.

The quantities of the auxiliary agent or compound which are to be applied must be accurately metered. The application sequence over time takes into account the actual distribution of ink residue and cleaning solution as observed on the running web, again measured over time. Cleaning the blankets one after another will, after all, produce another distribution of the cleaning solution than simultaneous cleaning of all contaminated blankets.

By restricting the applications of the agent to one or more areas while keeping it accurately metered, it is possible to compensate for local image variations which will influence the build-up of impurities and thus affect the utilization of the cleaning solution.

In order to keep the dryer inlet accessible for web infeed purposes, the applicator unit dispensing the agent (which is mounted in the dryer inlet area) is mounted so as to permit a sliding motion in and against the direction of the web. If the applicator unit is in the form of a spraying system, the nozzles are arranged in a row across the web and can be separately adjusted and taken on and off stream individually, permitting the user to apply the agent to certain areas only in accordance with a desired profile.

Guide rails and a servo drive for the sliding motion give the applicator unit (which can be partially enclosed in a casing) excellent handling properties.

The application of the medium, that is, the auxiliary agent or compound in accordance with optimum time and quantity characteristics for a given ink residue and cleaning solution load is ensured by a control system or unit which controls a number of presettable parameters such as the dot percentage, web speed, times and quantities of cleaning solution transfer to the individual printing units, and dryer state variables. The latter include the vapor concentration detected by the sensors, inlet and exhaust air, gas flow rates, etc. The values of the individual parameters are then used to provide the corresponding actuator settings. These comprise the cleaning cloth advance, cleaning agent release, application of the material, dryer flaps, and (where applicable) the gas supply. This control system or unit may be connected to the control panel of the printing line.

The invention is illustrated, merely by way of an example, in the accompanying drawings in which FIG 1 is a schematic view of a rotary offset press;

Figure 1:
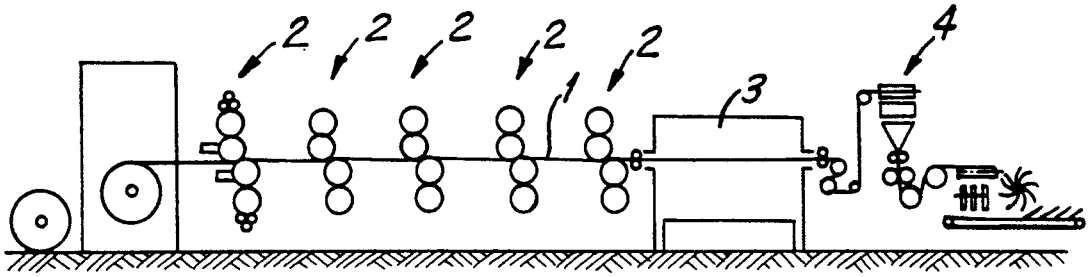

Referring to FIG. 1, the web 1 travels from the reel to the printing units 2 in which the corresponding colours are printed in true register. During printing of the web 1, fountain solution from the damping units will be conveyed to the blanket, and thus to the web 1, via the non-printing plate areas and the mixture of ink and damping solution. The moisture content of the web will increase. In the dryer 3, the heat-setting inks will set to the point where, after cooling down in their passage over the cooling cylinder surface, they can be processed in the folding unit 4 (FIG. 1), or press folder, without smearing.

The dryer 3 is equipped with inlet connections and exhaust stacks.

Figure 2:
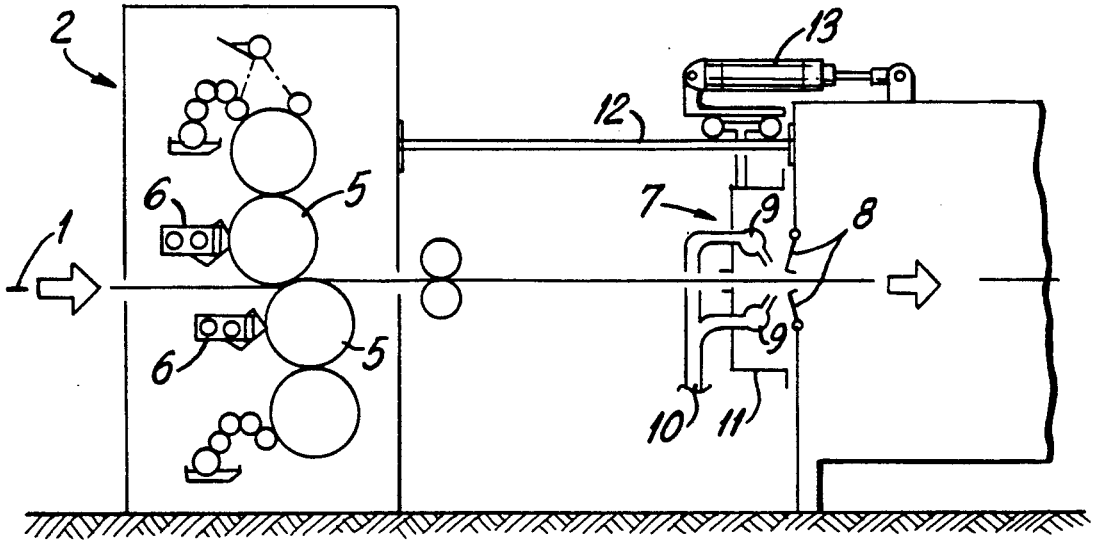
FIG. 2 is a view of the applicator unit between the last printing unit and the dryer.

FIG. 2 shows a cleaning beam 6 positioned, in each case, against the blanket cylinder for the front side 5 and the blanket cylinder of the back side 5. The inking and dampening rollers transfer the ink and the damping solution to the printing plate mounted on the plate cylinder.

In the four-cylinder system depicted here, the planes passing through the axes of the cylinder pairs (each formed by a plate and a blanket cylinder 5) are offset, so that the path of the web 1 through the nip between the front-side blanket cylinder 5 and the back-side blanket cylinder 5 has the form of the letter "S". This S-shaped path remains the same when the printing cylinders are in the 'impression off' position. The S-shaped path also means that the web 1 and the blanket cylinders 5 will touch, permitting the transfer of cleaning solution. In the last of the various printing units 2, where the application of ink is terminated, the degree of ink coverage is greatest. In multi-colour printing, therefore, the last printing unit 2 will operate on a web 1 already tinted in the previous printing units 2, causing a retransfer of these 'foreign' inks which mainly affects the rubber blanket.

The web continues its path to the dryer 3 with its successive drying sections. In the first drying section downstream of the dryer inlet, the temperature of the web 1 begins to increase markedly. The evaporation of vaporizable ink and cleaning solution components rises to a maximum, with the fume concentration increasing accordingly.

The dryer 3 possesses hinged flaps 8 for infeed and ventilation purposes. Ahead of the dryer inlet, there is arranged an applicator unit 7 consisting of a spraying system with a nozzle beam 9. After the web has left the printing units 2, but before it enters the dryer 3, the applicator unit 7 applies a specific material to the surface of the web 1 (approximately simultaneously with the cleaning cycle). In the case of face and back printing, this material is applied to the top and bottom of the web 1 by one nozzle beam for each side, mounted crosswise above and below the web 1, respectively, in an appropriate distance.

The outlet directions of the nozzles, indicated by the oblique lines, are adjustable. Their output can be regulated according to the individual requirements for given web areas, much like the inking zones can be controlled with the ink fountain slides.

Supply to the applicator unit 7 is via the pipe connections 10. To facilitate infeed and maintenance work on the dryer 3 and the applicator unit 7, the applicator unit 7 can be moved on two rolls travelling on a rail 12. The applicator unit 7 can be encapsulated in a casing 11. The servo drive 13 imparts motion to the applicator unit 7.

Figure 3:
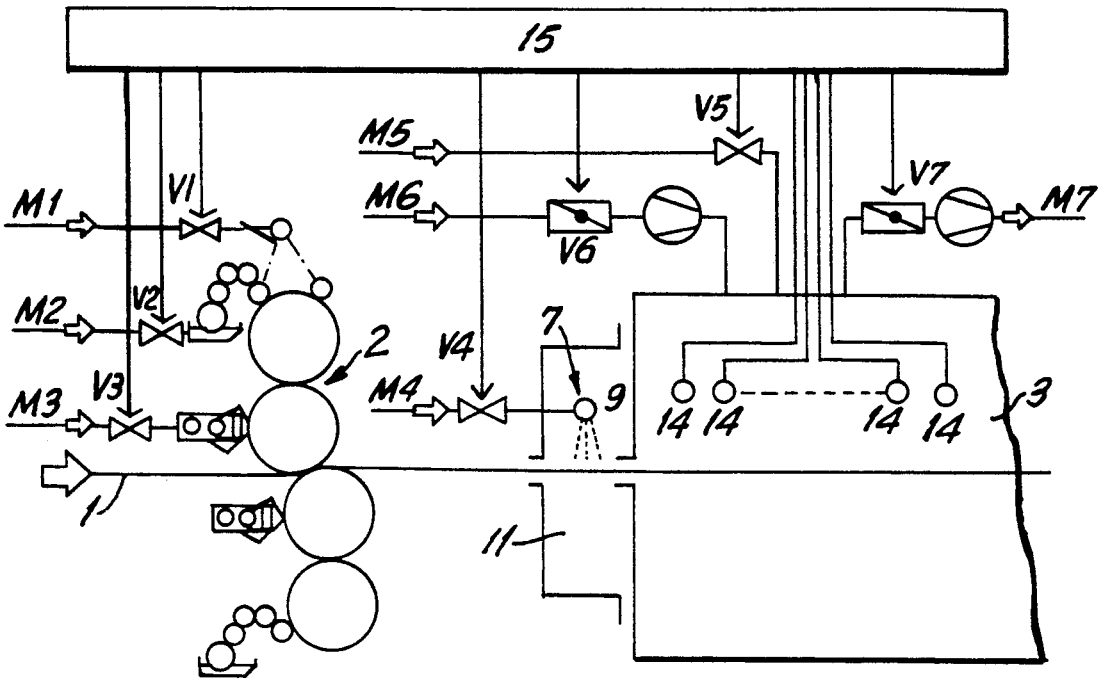
FIG. 3 is a schematic representation of the measuring and actuating circuits for a printing unit with blanket cleaning device, applicator unit for the medium, and dryer.

FIG. 3 mainly shows the flow paths in the medium and signal circuits which connect the cleaning unit 6 (i.e., the washing beam), the applicator unit 7, and the dryer 3.

As the cleaning cycle may also be influenced by the ink coverage, the separation into several zones has been extended to the ink and damping solution supplies. From a systematic point of view, the mass flows comprise the ink flow M1, the damping solution flow M2, the cleaning solution flow M3, the flow of the medium, that is, the auxiliary agent or compound applied by the applicator unit M4, the gas supply M5, the air supply M6, and the exhaust air flow M7. Signal lines lead to the actuators, which have here been represented as valves V1 to V5 or as flaps V6, V7 (refer to air supply and exhaust air flow). Valve V3 for the cleaning solution flow M3 also symbolizes the cleaning cloth advance.

The dryer 3 is equipped with detecting elements such as transducers 14 (FIG. 3) measuring the fume concentration along the drying path. Instead of the plurality of transducers 14 shown, the system may operate with a single detecting element or transducer in the exhaust stack, but it should be noted that its measuring signal will be delayed due to the distance from the web 1, where the decisive concentrations are present.

The transducers 14 may measure the fume concentrations either directly or indirectly, i.e., they can be of the FID, pressure-sensitive, heat-sensitive, or hot-wire probe type. The signal from the fume concentration measurement is used to control the influencing variables present at the dryer inlet, i.e., the cleaning solution quantity M3 and the quantity of the applied material M4, both with the corresponding time values.

Control is provided by a control unit 15 (FIG. 3) which can be connected to the operating panel of the rotary offset press.

The advantages of controlling the mass flows M1 . . . M7 with respect to both time and quantity are clearly evident from the fact that the fume concentration maxima occurring in time will also require a time-related applicator response.

Figure 4:
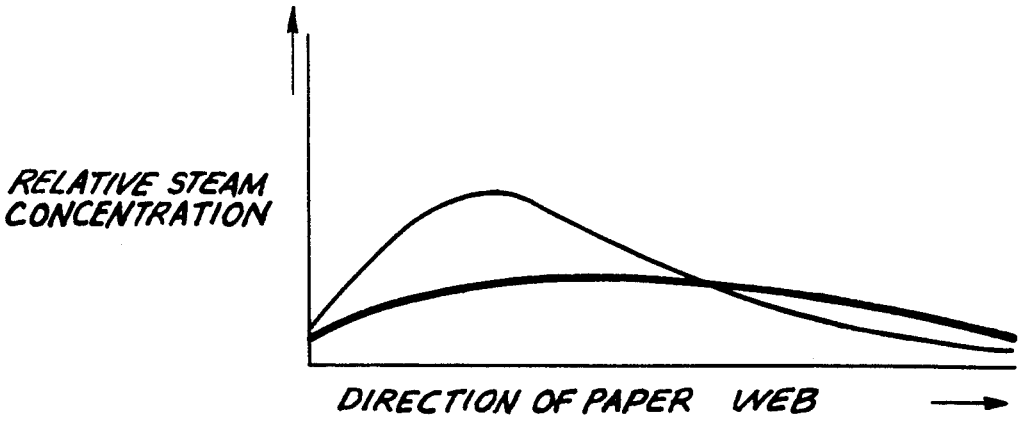
FIG. 4 shows the fume concentration curves across the length of the dryer.

FIG. 4 shows the measurable advantage of the process according to the invention. The curve with the higher peak shows the fume concentration without application of the material, the flatter curve reflects the fume concentration with material being applied.

What is claimed is:

1. Process for cleaning a rubber blanket and subsequently controlling the concentration of explosive or noxious fumes, said rubber blanket being mounted on a cylinder of a printing unit of a rotary offset printing press having a plurality of printing units, a dryer having a plurality of dryer sections and a web unwinding unit having a web disposed thereon, comprising applying cleaning solution having a frictional effect and dissolving power on contamination on said rubber blanket, passing said web, through said printing units and after it has been contacted with said rubber blanket of the last downstream printing unit, to said dryer after said printing units have printed thereon, applying an auxiliary compound to said web in the area between the last downstream printing unit and the first dryer section and controlling the vapor release resulting from the vaporization of non-aqueous ink ingredients carried along said web and from the vaporization of said cleaning solution in the dryer section.

2. Process according to claim 1 including applying the auxiliary compound in a quantity and at a time dependent upon the quantity and time of application of the upstream cleaning solution load in the printing press and minimizing the concentration of explosive or noxious vapors in the dryer.

3. Process according to claim 1 including finely distributing an inorganic auxiliary compound across the surface of the web.

4. Process according to claim 3 including finely distributing an inorganic auxiliary compound which contains ingredients which will precipitate into one or several layers across the surface of the web as the web is moved towards the dryer.

5. Process according to claim 1, including finely distributing water across the surface of web.

6. Apparatus for cleaning a rubber blanket and subsequently controlling the concentration of explosive or noxious fumes, said rubber blanket being mounted on a blanket cylinder of a printing unit of a rotary offset printing press comprising a plurality of printing units, a web including at least one printing surface, a web unwinding unit upon which said web is disposed and from which it is delivered in a downstream direction towards and through said printing units, a dryer having a plurality of drying sections and provided with an inlet and an outlet, a press folder, and a plurality of cleaning units with cleaning beams, said beams being arranged axially parallel with said blanket cylinder and carrying a controllable pressure element which permits time- and quantity-controlled supply of a cleaning solution to said blanket cylinder, and an applicator unit for metering and applying controlled quantities of an auxiliary compound to said at least one printing surface of said web, said applicator unit being located in the area between the last printing unit and the first drying section of the dryer.

7. Apparatus according to claim 6 wherein the applicator unit is a spraying device equipped with at least one nozzle mounted in parallel with the web.

8. Apparatus according to claim 6 including at least one detecting element for measuring the concentration of explosive or noxious vapors, actuators controllable to provide the correct load of auxiliary compound applied to the web, said auxiliary compound being supplied to the cleaning unit and to the dryer dependent on the concentration of explosive or noxious vapors detected by said detecting element, and a controlling unit which processes signals from said detecting element and signals said actuators to provide the correct load of said auxiliary compound to said web.

9. Apparatus according to claim 8 wherein the rotary offset printing press includes a control unit desk and the controlling unit in incorporated into said control desk.

10. Apparatus for cleaning a rubber blanket and subsequently controlling the concentration of explosive and noxious fumes, said rubber blanket being mounted on a blanket cylinder of a printing unit of a rotary offset printing press comprising a plurality of printing units, a web including at least one printing surface, a web unwinding unit upon which said web is disposed and from which it is delivered in a downstream direction towards and through said printing units, a dryer having a plurality of drying sections and provided with an inlet and an outlet, a pressure folder, and a plurality of cleaning units with cleaning beams, said beams being arranged axially parallel with said blanket cylinder and carrying a controllable pressure element which permits time- and quantity-controlled supply of a cleaning solution to said blanket cylinder, and an applicator unit for metering and applying controlled quantities of an auxiliary compound to said at least one printing surface of said web, said applicator unit being located in the area between the last printing unit and the first drying section of the dryer at the inlet of said dryer and includes means for imparting a sliding motion to said applicator unit parallel to the direction of travel of the web.

11. Apparatus for cleaning a rubber blanket subsequently controlling the concentration of explosive or noxious fumes, said rubber blanket being mounted on a blanket cylinder of a printing unit of a rotary offset printing press comprising a plurality of printing units, a web including at least one printing surface, a web unwinding unit upon which said web is disposed and from which it is delivered in a downstream direction towards and through said printing units, a dryer having a plurality of drying sections and provided with an inlet and an outlet, a pressure folder, and a plurality of cleaning units with cleaning beams, said beam being arranged axially parallel with said blanket cylinder and carrying a controllable pressure element which permits time- and quantity-controlled supply of a cleaning solution to said blanket cylinder, and an applicator unit for metering and applying controlled quantities of an auxiliary compound to said at least one printing surface of said web, said applicator unit being located in the area between the last printing unit and the first drying section of the dryer at the inlet of said dryer and includes means for imparting a sliding motion to said applicator unit parallel to the direction of travel of the web, said means for imparting sliding motion to said applicator unit including guide rails and a servo drive.

* * * * *